United States Patent [19]

Kishi et al.

[11] 4,009,458

[45] Feb. 22, 1977

[54] PUFFER TYPE GAS CIRCUIT BREAKER

[75] Inventors: Tuneo Kishi; Hiroshi Itoh; Masaoki Tamura; Seizo Nakano; Masao Hosokawa, all of Hitachi, Japan

[73] Assignee: Hitachi, Ltd., Japan

[22] Filed: Apr. 15, 1975

[21] Appl. No.: 568,179

[52] U.S. Cl. ..... 200/148 A; 200/150 G

[51] Int. Cl.[2] ..... H01H 33/82

[58] Field of Search ..... 200/148 A, 148 D, 150 G

[56] References Cited

UNITED STATES PATENTS

| | | | |
|---|---|---|---|
| 2,981,814 | 4/1961 | Friedrich | 200/148 A |
| 3,763,340 | 10/1973 | Noack | 200/148 D |
| 3,922,512 | 11/1975 | Benham | 200/148 D |

*Primary Examiner*—George Harris
*Attorney, Agent, or Firm*—Craig & Antonelli

[57] ABSTRACT

In a puffer type gas circuit breaker comprising at least a pair of main movable and fixed contacts, a puffer device and a pair of preinsertion resistor contacts inserted electrically in parallel with the main movable and fixed contacts, the preinsertion resistor contacts are closed prior to the closing of the main movable and fixed contacts, and are separated a short time after the main movable and fixed contacts have been closed.

6 Claims, 10 Drawing Figures

PUFFER TYPE GAS CIRCUIT BREAKER

BACKGROUND OF THE INVENTION

The present invention relates in general to a puffer type gas circuit breaker and more particularly an improvement of puffer type gas circuit breakers provided with a pair of preinsertion resistor contacts.

When a circuit breaker inserted in extrahigh voltage transmission lines is closed, a switching overvoltage or switching surge voltage is generated, causing damage to the insulation of the electrical equipment in the transmission system. In order to overcome this problem, the power circuit breakers used in extrahigh voltage transmission systems are in general provided with a preinsertion resistor contact unit (to be referred to as "resistor contact unit" in this specification) electrically inserted in parallel with a pair of main movable and fixed contacts and comprised of a pair of movable and fixed resistor contacts and a preinsertion resistor assembly. The resistor contact unit closes the circuit through the preinsertion resistor assembly prior to the closing of the main movable and fixed contacts so that the generation of a switching overvoltage is prevented.

However, even though the resistor contact unit has a sufficient closing capacity, it does not have opening or interrupting capacity. Therefore, in general, the resistor contact unit should be opened before the interrupter unit is opened, and the extinction of the arc is carried out only between the main movable and fixed contacts of the interrupter unit. Therefore, the resistor contact unit must always have a higher dielectric strength than that of the interrupter unit through all of their transient opening strokes. Otherwise, the arc is re-established between the movable and fixed resistor contacts for which there is provided no means for extinguishing the arc so that the interruption cannot be attained. Therefore, when the circuit breaker is opened, the resistor contacts must be separated and spaced apart by a distance sufficient to prevent the transient dielectric breakdown between the resistor contacts before the main movable and fixed contacts of the interrupter unit are opened. If the closing or opening of the resistor contact unit is carried out concurrently of the closing or opening of the interrupter unit, the resistor contacts cannot be spaced apart from each other by a sufficient distance. Especially in the puffer type gas circuit breakers inserted in the extrahigh voltage transmission lines of the type which can accomplish the interruption within two cycles after it has received the tripping signal, the opening time of the main movable and fixed contacts is extremely short and is of the order of 10 to 20 milliseconds.

Another requirement for the circuit breaker is to operate with trip free duty, which means "close-open" operation.

Considering this case, it is extremely difficult to separate the resistor contacts by a sufficient distance within such an extremely short time prior to the opening of the main movable and fixed contacts, if they are operated concurrently by the same tripping signal coming immediately after closing operation.

SUMMARY OF THE INVENTION

One of the objects of the present invention is therefore to provide a puffer type gas circuit breaker which may open a pair of movable and fixed resistor contacts and separate them by a distance sufficient for preventing the transient dielectric breakdown therebetween when the breaker is opened.

Another object of the present invention is to provide a puffer type gas circuit breaker in which the assembly and disassembly of a preinsertion resistor contact unit and an operating mechanism therefor may be much facilitated.

A further object of the present invention is to provide a puffer type gas circuit breaker in which the shocks or impacts caused when the resistor contact unit is opened or closed may be minimized.

To the above and other ends, the present invention is based upon the underlying principle that a resistor contact unit which is closed or opened prior to the closing or opening of an interrupter unit is opened immediately after the interrupter unit has been closed.

Therefore, according to the present invention, after the interrupter unit has been closed, the resistor contact unit is immediately opened by an operating linkage which is operatively coupled to another operating linkage which actuates the interrupter unit to close or open. Furthermore when the resistor contact unit is closed, energy sufficient enough to cause the resistor contact unit to open is stored. A short time after the interrupter has been closed, a driving member of the resistor contact unit is released from the operating linkage so that the movable contact may be returned to its initial opened position by the stored energy. According to the present invention, the resistor contact unit can be made very compact, comprising an insulating cylinder enclosing therein a subassembly consisting of a fixed resistor contact and a preinsertion resistor assembly and a subassembly consisting of a movable resistor contact and energy storage means such as a coiled compression spring.

Since the resistor contact unit is provided as a unit as described above, the closing timing of the movable resistor contact, the opening or returning speed, and so on may be adjusted independently of an interrupter unit. Furthermore in case of a multi-break type circuit breaker in which a plurality of interrupter units are connected in series, the assembly and disassembly of the resistor contact units may be much facilitated.

According to the present invention, the driving member which is operatively coupled to the operating linkage for driving the movable resistor contact of the resistor contact unit into contact with the fixed resistor contact are provided as separate parts, but they are so arranged as to be pressed against each other.

When the puffer type gas circuit breaker is opened, a blow of high pressure gas must be produced through compressing the gas in the puffer cylinder in order to extinguish the arc. And in order to accomplish the interruption with two cycles a high-speed operating or driving mechanism is used so that the operating linkages are subjected to such big forces of the order ranging from ten to several tens of tons. Therefore, in the interrupting or opening operation, the operating linkage coupled to the resistor contact unit is also actuated at high speeds so that it is subjected to severe shocks or impacts at the end of the interruption or opening stroke.

To overcome this problem, according to the present invention, the operating linkage coupled to the resistor contact unit is provided with engaging and releasing means which engages with the driving member in the closing operation or stroke but is released therefrom a very short time after the interrupter unit has been closed. Therefore in the opening or interrupting stroke, some members of the operating linkage coupled to the resistor contact unit may cooperate with the operating linkage coupled to the interrupter unit, but the remaining members of the former may operate independently of the latter so that the shocks or impacts acting upon the former may be minimized.

The above and other objects, features and advantages of the present invention will become more apparent from the following description of the preferred embodiments thereof taken in conjunction with the accompanying drawings.

DESCRIPTION OF THE PREFERRED EMBODIMENTS

Figure 1:
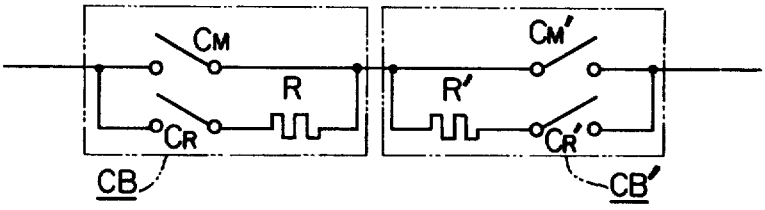
FIG.1 PRIOR ART
FIG. 1 is a circuit diagram of a two-breaker circuit breaker with preinsertion resistors.
Figure 2A:
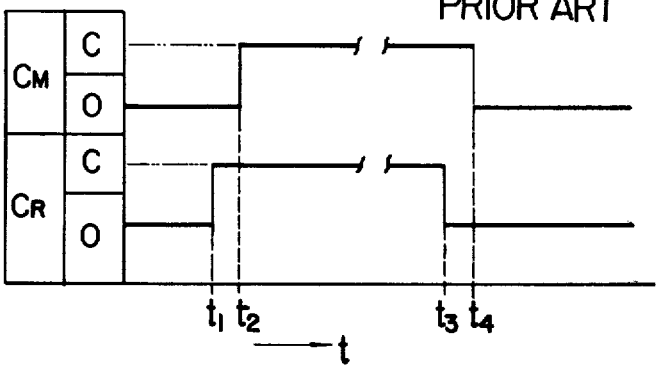
FIG.2A PRIOR ART
FIG. 2A is a timing sequence chart of the closing and opening thereof.

Prior to the description of the preferred embodiments of the present invention, referring to FIGS. 1 and 2A the mode of operation of a conventional multibreak type circuit breaker with two interrupter units CB and CB' will be described in order to clearly point out the features of the present invention. As shown in FIG. 1, the interrupter units CB and CB' having main contacts $C_M$ and $C_M'$ connected in parallel with resistor contacts $C_R$ and $C_R'$ and preinsertion resistors R and R'. The closing and opening timing sequence of each interrupter CB or CB' is shown in FIG. 2A. When the interrupter is closed, the resistor contact $C_R$ is closed at the time $t_1$, and then the main contact $C_M$ is closed at the time $t_2$ short time interval after the time $t_1$. Thus the circuit is closed. During the time the interrupter is kept closed, the resistor contact $C_R$ is also kept closed. When the interrupter is to be opened in response to the tripping signal, first the resistor contact $C_R$ is opened at the time $t_3$, and then the main contact $C_M$ is opened at the time $t_4$. In general, the interrupting time of the puffer type two cycle circuit breakers is so short that the allowable time interval between the time $t_3$ and the time $t_4$ is extremely small and is of the order of a few milli seconds. Therefore, it is extremely difficult to space apart the pair of resistor contacts within such an extremely short time interval by such a sufficient distance that the transient dielectric breakdown between them may be positively prevented. The present invention was made to overcome this problem.

Figure 2B:
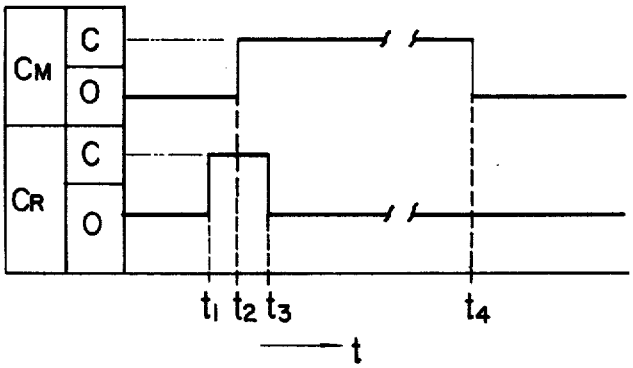
FIG. 2B is a timing sequence chart of the closing and opening of a circuit breaker in accordance with the present invention.

According to the present invention, as shown in FIG. 2B, when the interrupter is closed the resistor contact is closed at the time $t_1$, and then the main contact $C_M$ is closed at the time $t_2$ in the conventional manner, but the resistor contact $C_R$ is immediately opened at the time $t_3$, after a very short time after the time $t_2$. Therefore, when the interrupter is to be opened, only the main contact $C_M$ is opened in response to the tripping signal while the resistor contact $C_R$ remains opened. Therefore, the above described problem encountered in the conventional circuit breakers may be overcome by the present invention.

First Embodiment, FIGS. 3, 4A, 4B and 4C

Figure 3:
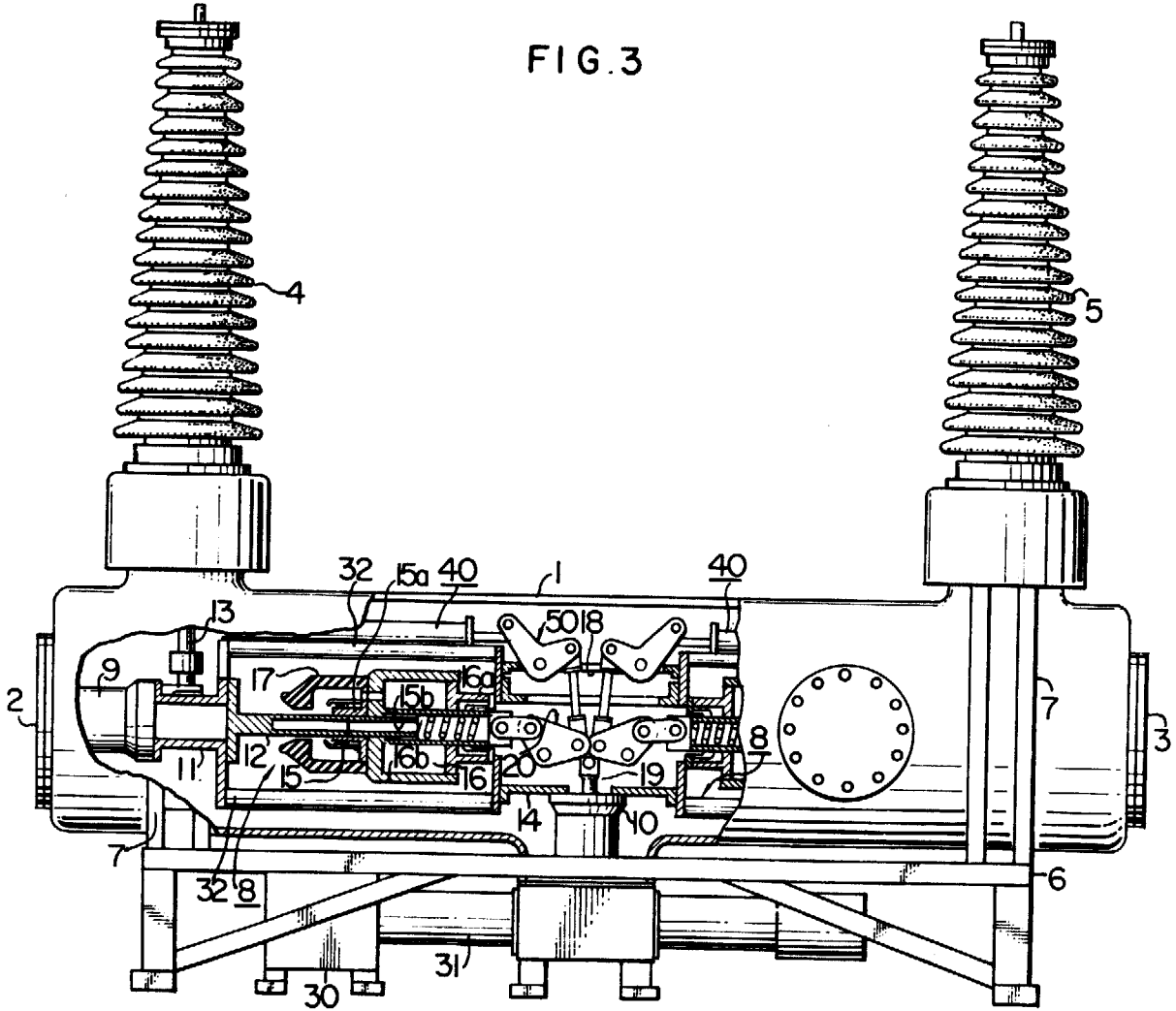
FIG. 3 is a side view, partly broken of a first embodiment of a puffer type gas circuit breaker in accordance with the present invention.

The first embodiment of the present invention is a dead tank type puffer gas circuit breaker with two interrupter units. In FIG. 3 the details of a preinsertion resistor contact device and an operating linkage are not shown, but they will be described in detail with reference to FIGS. 4A, 4B and 4C.

Referring to FIG. 3, a metal tank 1 has its opened ends hermetically sealed with end plates 2 and 3, and is filled with an arc suppressing or extinguishing gas, such as $SF_6$. Two terminal bushings 4 and 5, which are spaced apart from each other by a suitable distance, are attached to the top side of the metal tank 1 and supported by a supporting framework 6 through ribs 7. Two interrupter units each generally designated by 8 are enclosed in the metal tank 1, and each of them is interposed between and supported by an insulating supporting cylinder 9 securely attached to the inner wall of a respective one of the end plates 2 or 3 and a central insulating supporting cylinder 10 located substantially at the midpoint between the axial length of the metal tank 1. More particularly, the insulating supporting cylinder 9 is connected to a fixed main contact 12 of the interrupter unit 8 through a supporting conductor 11 which is a main circuit conductor and is connected to a central conductor 13 extending through the terminal bushing 4 or 5. To a central bracket 14 which is attached to the central insulating supporting cylinder 10 is electrically connected a movable main contact unit generally indicated by 15 and comprised of a main movable contact 15*a* and an arcing contact 15*b*. The two interrupter units 8 are electrically interconnected to each other through a connecting conductor 18 mounted on the central bracket 14.

A puffer device generally indicated by 16 and comprised of a puffer piston 16*a* and a puffer cylinder 16*b* for compressing the arc suppressing or extinguishing gas is assembled with the movable main contact unit 15. In the instant embodiment, the puffer piston 16*a* is attached to the central bracket 14 while the puffer cylinder 16*b* is movable as will be described in detail hereinafter. An insulating nozzle 17 is attached to the puffer cylinder 16*b* to enclose therein a movable main contact unit 15 so that the arc-suppressing or -extinguishing gas compressed by the puffer device 16 may be directed to the portion where the fixed and movable main contacts 12 and 15*a* contact with each other or separate from each other. Both the movable main contact unit 15 and the puffer device are operatively connected to a control mechanism (not shown) enclosed in a control chamber 30 through a first operating linkage 20 which in turn is operatively coupled to an insulating operating rod 19 which is extended through the central supporting cylinder 10 and is coupled to a connecting lever (not shown) extending through a cylinder 31 interposed between the central supporting cylinder 10 and the control cabinet 30.

In order to equally divide the voltage imposed on the interrupter units 8, a voltage dividing capacitor 32 and a preinsertion resistor device 40 are interposed in parallel between the fixed main contact 12 of the interrupter unit 8 and its corresponding movable contact unit 15. The preinsertion resistor device 40 is actuated by a second operating linkage generally indicated by 50 and operatively coupled to the first operating linkage 20 as will be described in detail hereinafter.

Next referring to FIG. 4A, the constructions of the interrupter unit 8, the preinsertion resistor device 40 and the first and second operating linkages 20 and 50 will be described in detail.

The first operating linkage 20 comprises a triangle lever 22 which is pivoted to the central bracket 14 with a pivot pin 21 at its first vertex, a link 25 whose one end is pivoted with a pin 24 to the upper end of the operating rod 19 and whose other end is pivoted with a pin 23 to a second vertex of the lever 22, and another link 29 whose one end is pivoted to a third vertex of the lever 22 with a pin 26 and whose other end is pivoted with a pin 28 to a puffer shaft 27 formed integrally with and extended from the puffer cylinder **16*b***.

The second operating linkage 50 comprises a rocker lever 52 which is pivoted with a pin 51 to the central braket 14, a connecting link 54 whose one end is connected with a pin 53 to one end of the rocker lever 52 and whose other end is pivoted with the common pin 23 to the other end of the link 25, a pushing lever 56 which is pivoted with a pin 55 to the other end of the rocker lever 52, and a biasing spring 57 loaded between the rocker lever 52 and the pushing lever 56 in order to bias the pushing lever 56 in the clockwise direction. One end of the pushing lever 56 terminates into a releasing portion 59 while the other end forms a pushing or engaging portion 58.

Various parts to be described hereinafter of the preinsertion resistor device 40 are enclosed in an insulating cylinder 49 interposed between the central bracket 14 and the supporting conductor 11, so that the device 40 may be provided as a unit.

A preinsertion resistor assembly 41 and its fixed resistor contact 42 with a wipe spring 48 loaded therebetween are attached to the supporting conductor 11 and are enclosed by an insulating cylinder 46 which in turn is also attached to the supporting conductor 11. At the opened end of the insulating cylinder 46 is disposed a static shield 47. The preinsertion resistor assembly 41 may be of the bobbin or leaf type, but in the instant embodiment it is a lamination of a plurality of pellet shaped resistor plates stacked to a desired resistance.

The pellet resistor plates are in the form of a ring so that the fixed resistor contact 42 may be fitted into the passage formed thereby.

A movable rod-shaped resistor contact 43 is enclosed within a conducting cylinder 44 which also functions as a current collector and is attached to the central bracket 14. A return spring 45 is loaded within the conducting cylinder 44 between a spring stop **43*a* formed integral with the rod-shaped movable contact 43 and the open end of the cylinder 44**.

One end of a driving member 60 is pressed against the spring stop or flange **43*a* of the movable contact 43 while the other end thereof is provided with a roller 61 in engagement with the pushing or engaging end 58 of the pushing lever 56. The driving member 60 is guided for a horizontal displacement not only by a guide member 62 attached to the central bracket 14 but also by another guide member (not shown). A release pin 63 is extended from the central bracket 14 for engagement with the releasing portion 59 of the pushing lever 56 so that the movable resistor contact 43** may be returned to its initial portion as will be described in detail hereinafter.

Figure 4A:
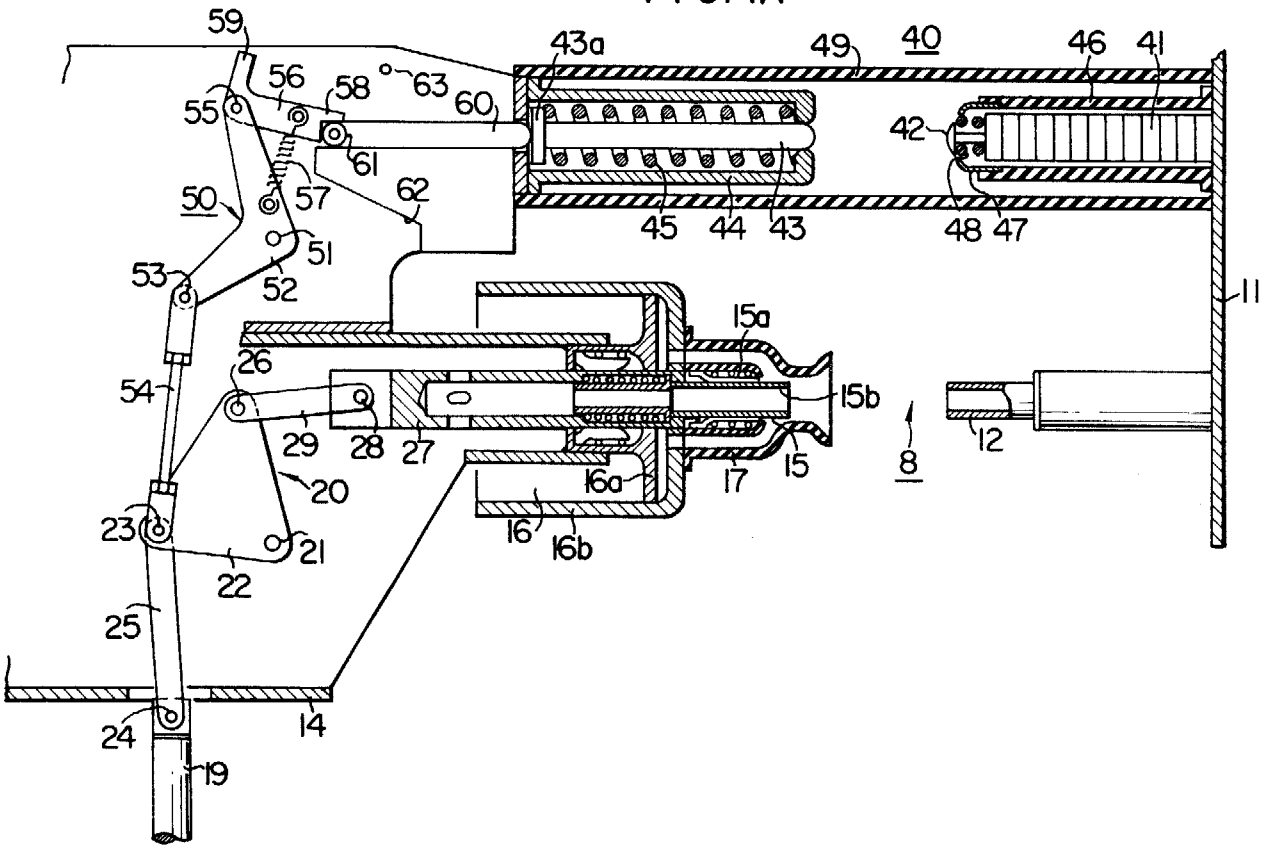
FIGS. 4A, 4B and 4C are fragmentary sectional views, on enlarged scale, thereof illustrating an interrupter unit and a resistor contact unit, FIG. 4A showing the opened state, FIG. 4B showing the closed resistor contact with the interrupter unit being closed, and FIG. 4C showing the closed circuit breaker.

In the state shown in FIG. 4A, the interrupter unit 8 is opened.

Figure 4B:
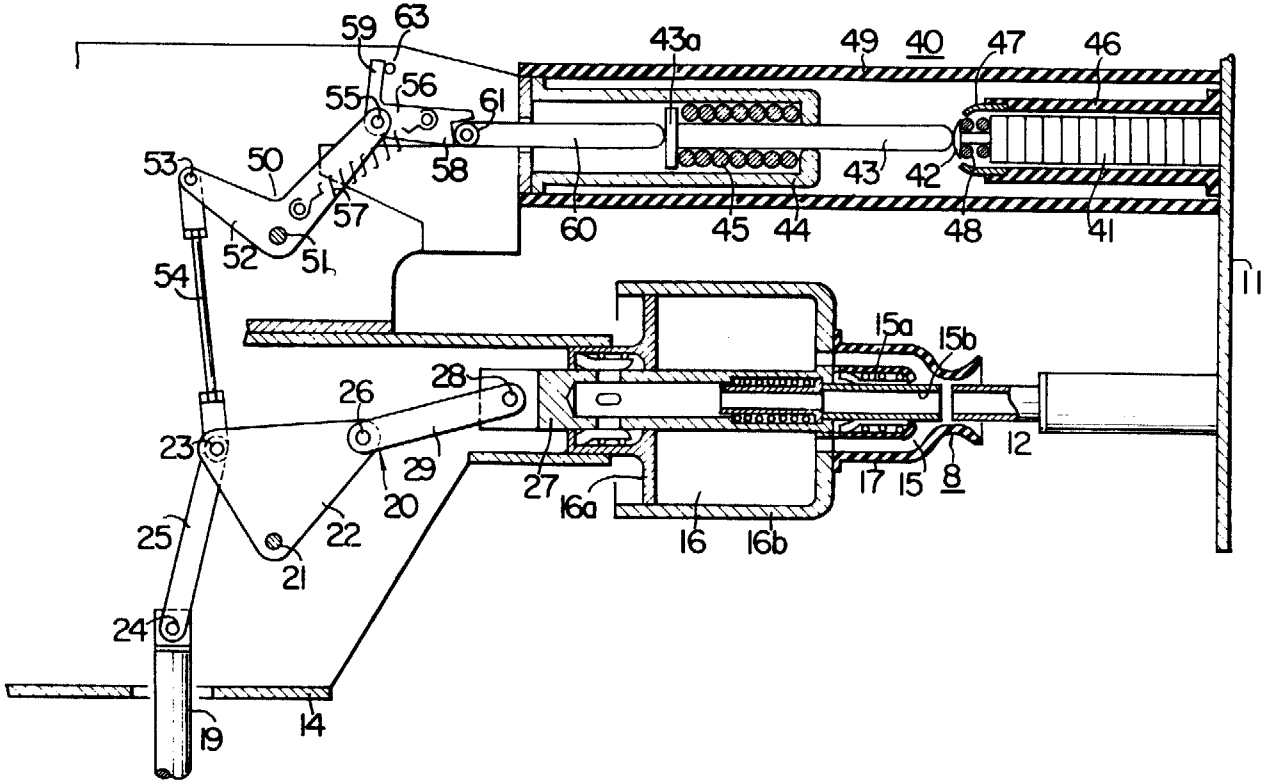

Next referring further to FIGS. 4B and 4C, the mode of operation of the interrupter unit 8 with the above construction will be described hereinafter. In response to the closing signal, the control mechanism in the cabinet 30 causes the operating rod 19 to move upwardly so that the various parts are displaced to the positions in FIG. 4B through the first and second operating linkages 20 and 50. More particularly, the first operating linkage 20 causes both the main movable contact unit 15 and the puffer cylinder **16*b* to displace themselves toward the right. The second operating linkage 50 causes the driving member 60 to displace itself toward the right, thereby driving the movable contact 43 into contact with the fixed resistor contact 42 while compressing the return spring 45. But the main movable contact 15*a* is spaced apart from the main fixed contact 12 by a small distance. The above displacements of the main movable contact 15*a* and the movable resistor contact 43 may be attained by the suitable selection of a lever ratio between the first and second operating linkages 20 and 50**.

Figure 4C:
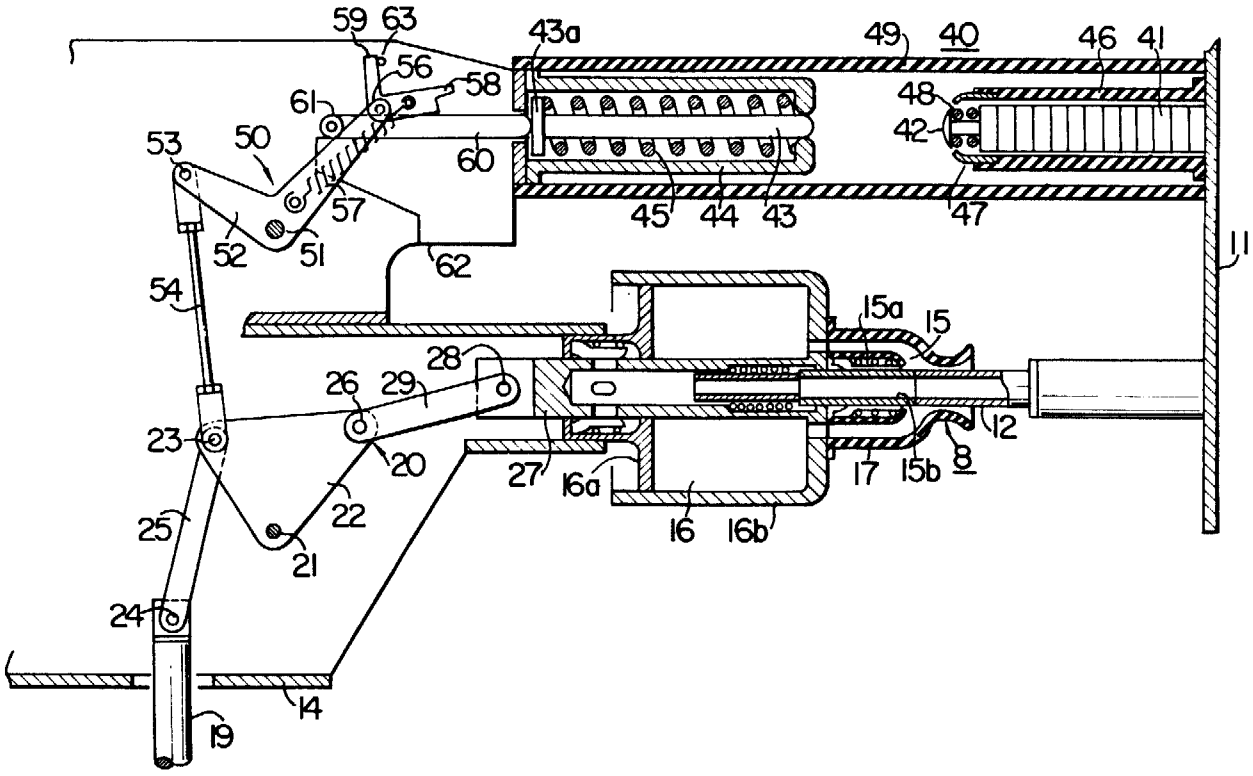

When the operating rod 19 further rises, the main movable contact **15*a* is advanced into contact with the main fixed contact 12, as shown in FIG. 4C, but the releasing portion 59 of the pushing lever 56 engages with the fixed pin 63 so that the pushing lever 56 is caused to rotate in the counterclockwise direction about its pivot pin 55. Consequently, the pushing or engaging portion 58 of the lever 56 is disengaged from the roller 61 of the driving member 60 so that the latter is caused to return its initial position under the force of the return spring 45. Therefore the movable resistor contact 43 is immediately separated from the fixed resistor contact 42, and is returned to its initial position as shown in FIG. 4C. Thus the preinsertion resistor device 40** is open-circuited.

In response to the tripping signal, the control mechanism lowers the operating rod 19 so that the various parts are returned to their respective initial positions as shown in FIG. 4A. Thus, the interrupter unit 8 is reset and is ready to be closed again.

In the first embodiment, during the upward stroke of the operating rod 19, the releasing portion 59 of the pushing lever 56 engages with the pin 63 so that the driving member 60 and hence the movable resistor contact 43 may be released to return to their initial positions. But the above arrangement has a defect in that the engagement of the releasing portion 59 of the pushing lever 56 with the release pin 63 causes relatively greater impact. Furthermore, both the first and second operating linkages 20 and 50 are returned at high speeds to their initial positions when the interrupter unit 81 is opened so that the parts of the second operating linkage 50 and especially the pushing lever 56 tend to be subjected to the relatively large shocks at the end of their return stroke because of their inertia. According to the second embodiment of the present invention, the above problems may be substantially overcome.

Figure 5A:
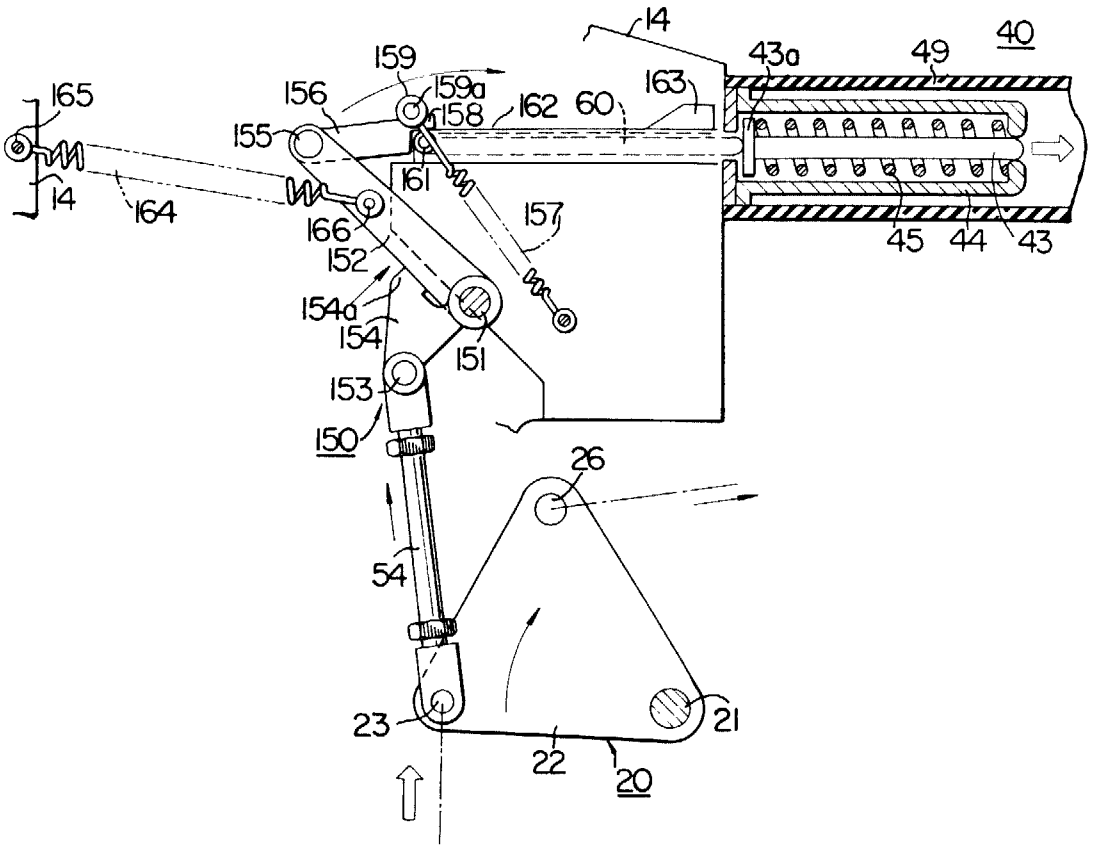
FIGS. 5A, 5B and 5C are views of a second embodiment of the present invention, FIG. 5A showing the opened stage, FIG. 5B showing the resistor contact unit being returned to the initial opened position with the interrupter unit being still closed and FIG. 5C showing the transient state of opening operation.
Figure 5B:
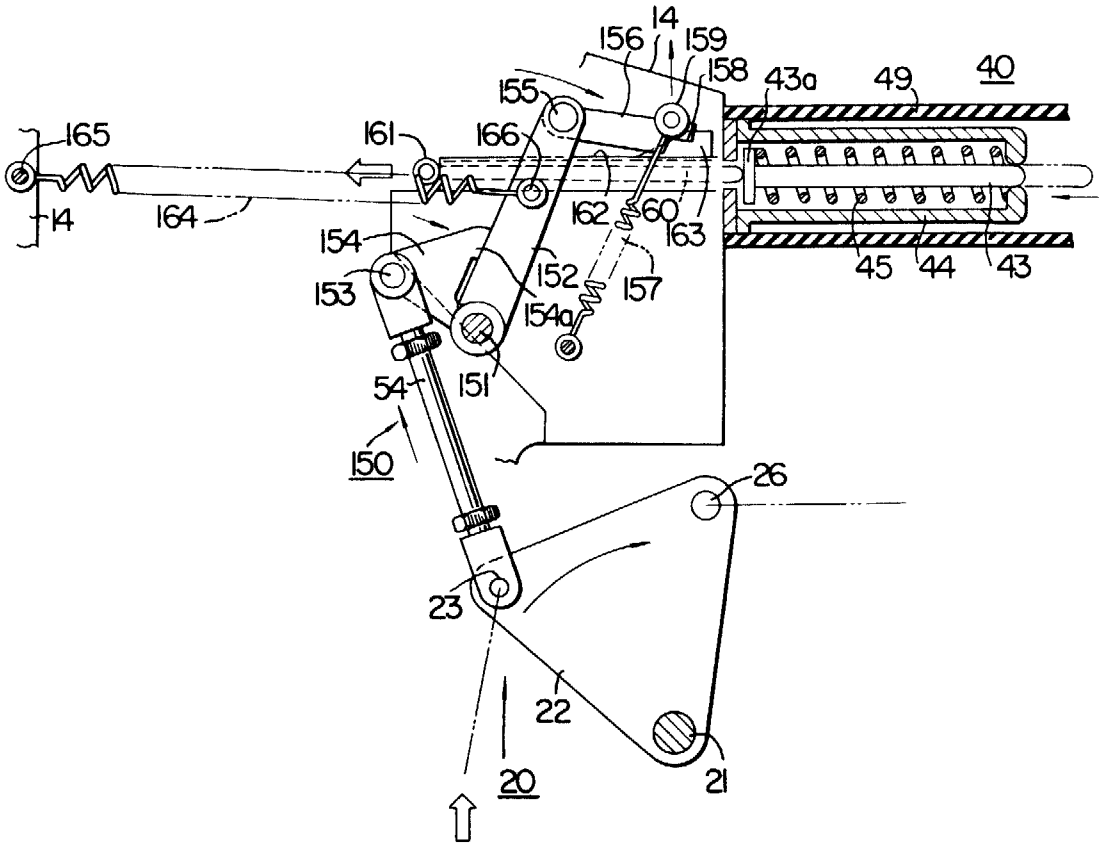
Figure 5C:
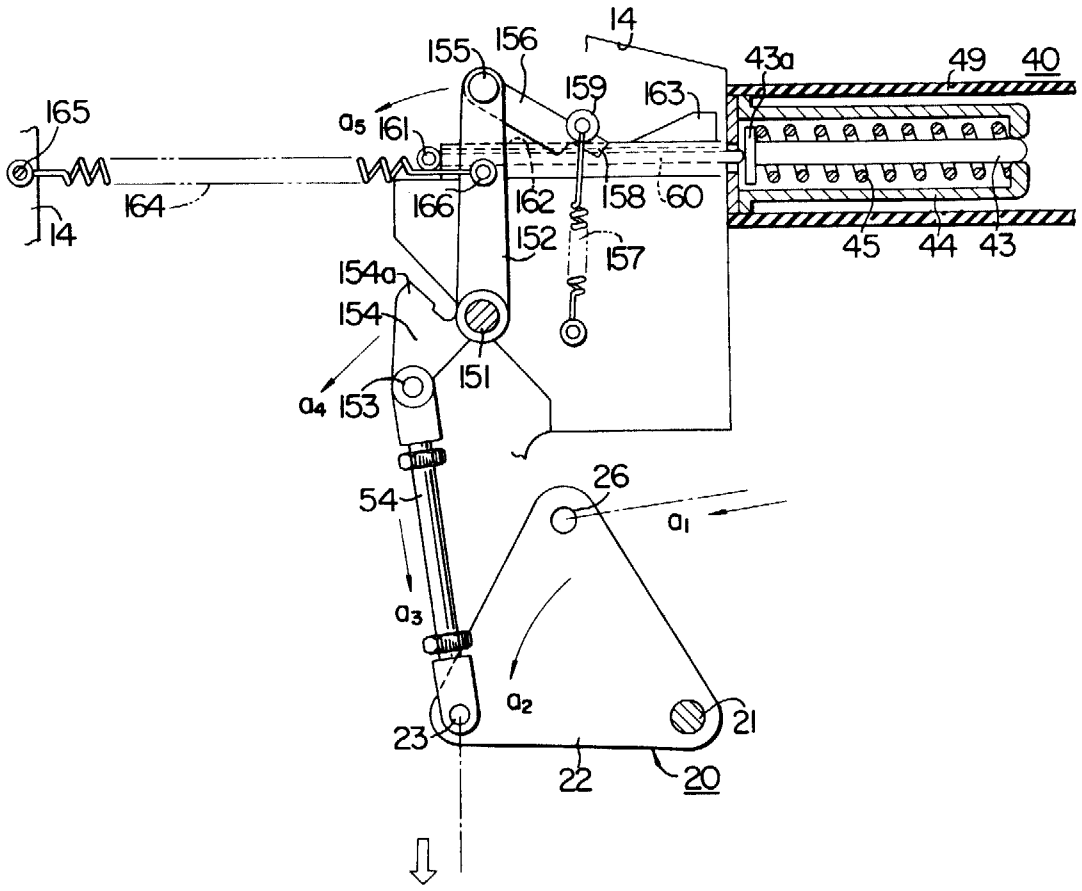

Second Embodiment, FIGS. 5A, 5B and 5C

The second embodiment of the present invention mainly concerns the improvement of the second operating linkage generally indicated by 150 in FIGS. 5A, 5B and 5C. As with the first embodiment, a pushing lever 156 has its one end pivoted with a pin 155 to one end of the lever 152 and has its other end formed into a pushing or engaging portion 158 for engagement with the roller 161 at one end of the driving member 60, but in contrast to the first embodiment the upper end of the link 54 is not directly connected to the lever 152 (which corresponds to the rocker lever 52 in the first embodiment), but is connected thereto through an intermediate lever 154. More particularly, the upper end of the link 54 is pivoted with a pin 153 to one vertex of the triangular lever 154 whose second vertex is pivoted with a pin 151 to the other or lower end of the lever 152. A pushing portion 154*a* at a third vertex of the lever 154 is pressed against the lever 152. Therefore when the interrupter unit 8 is closed, the driving force is transmitted from the link 54 to the lever 152 through the pushing portion 154*a* of the intermediate lever 154 as shown in FIGS. 5A and 5B, but when the interrupter unit is opened, the levers 152 and 154 are displaced independently of each other as will be described in detail hereinafter. One end of a tension spring 164 is attached to a pin 165 which in turn is attached to the central bracket 14, while the other end is attached to a pin 166 extending from the lever 152 so that the latter is normally biased to rotate in the counterclockwise direction. A guide roller 159 is attached with a pin 159*a* to the pushing or engaging end 158 of the pushing lever 156, and is biased by a spring 157 so that the guide roller 159 may be pressed against a guide member 162. A cam member 163 is attached to the guide member 162 so that the guide roller 159 may ride over the cam member 163 as shown in FIG. 5B at the end of the closing stroke of the movable resistor contact 43.

In the state shown in FIG. 5A, the interrupter unit 8 is opened.

In response to the closing signal, the operating rod (not shown) causes the lever 22 to rotate in the clockwise direction so that the link 54 of the second operating linkage 150 is displaced upwardly. As a result, the pushing portion 154*a* of the intermediate lever 154 pushes the lever 152 to rotate also in the clockwise direction. The push lever 156 is displaced toward the right so that its pushing portion or end 153 pushes the driving member 60. The driving member 60 in turn pushes the movable resistor contact 43 into contact with the fixed resistor contact (not shown). As with the case of the first embodiment, the main movable contact is advanced into contact with the main fixed contact a short time after the movable resistor contact has come into contact with the fixed resistor contact. The guide roller 159 rides over the cam member 163 as shown in FIG. 5B so that the engaging portion 158 of the push lever 156 is disengaged from the roller 161 of the driving member 60. Consequently, the driving member 60 and hence the movable resistor contact 43 are returned to their initial positions. In the second embodiment, since the push lever 156 is released from the driving member 60 when the guide roller 159 rides over the cam member 163 as described above, the members of the second operating linkage 150 may be prevented from being subjected to the shocks.

In response to the opening or interrupting signal, the operating rod is displaced downward at a high speed so that the lever 22 is caused to rotate in the counterclockwise direction as indicated by the arrows $a_1$ and $a_2$ in FIG. 5C. The link 54 and the intermediate lever 154 are therefore displaced at high speeds in the directions indicated by the arrows $a_3$ and $a_4$, respectively, but the lever 152 and the push lever 156 are returned to their initial positions under the force of the spring 164 independently of the displacements of the intermediate lever 154. In other words, the lever 152 and the push lever 156 of the second operating linkage 150 are operatively independent from the operation of the first operating linkage 20, and are returned to their initial positions at speeds which are dependent only upon the force of the tension spring 164 so that the shocks and impacts caused when the interrupter unit is opened may be considerably suppressed.

When the lever 152 is again advanced into engagement with the pushing portion 154*a* of the intermediate lever 154, the pushing portion or end 158 of the push lever 156 also engages with the roller 161 of the driving member 60 again so that the interrupter unit may be ready to start the next closing operation at any time. It is to be understood that the present description is illustrative rather than restrictive and that variations, alterations and/or modifications may be resorted to without departing from the sprint of the present invention.

What is claimed is:

1. A puffer type gas circuit breaker of the type comprising:

a. an interrupter unit comprising a main fixed contact, a main movable contact movably disposed in opposed relation with said main fixed contact between a position where it is in contact with and a position where it is separated from said main fixed contact, and a puffer device for compressing and blowing arc-affecting gases across the arc established between the main fixed and movable contacts when the same are separated from each other, b. a preinsertion resistor contact unit electrically connected in parallel with the main fixed and movable contacts of the interrupter unit and comprising a fixed resistor contact, a preinsertion resistor assembly electrically connected in series with said fixed resistor contact, and a movable rod-shaped resistor contact having a contact end opposed to said fixed resistor contact and being movably disposed in opposed relation with said fixed resistor contact to be moved into contact therewith or separated therefrom and having means for biasing said movable resistor contact into a normally opened position, c. first operating means for actuating said main movable contact and said puffer device, and d. second operating means comprising a driving member positioned so as to be pressed at one end thereof against the end of the movable rod-shaped resistor contact opposite to the contact end thereof, a pushing member having one end thereof disposed in opposed relation with said driving member, means for biasing said one end of said pushing member to be pressed against the other end of said driving member, linkage means mechanically connected between said first operating means and the other end of said pushing member for displacing said pushing member, said driving member, and said movable resistor contact from an original position where said movable and fixed resistor contacts are separated to a position where said movable and fixed resistor contacts are engaged, release means for disengaging the end of said pushing member from the end of said driving member, and means responsive to operation of said release means for returning only the movable resistor contact and driving member to their original positions immediately after said movable rod-shaped resistor contact engages with said fixed resistor contact and both the contacts of the interrupter unit are closed.

2. A puffer type gas circuit breaker as set forth in claim 1, wherein said linkage means comprises a rocker lever and said disengaging means comprises a release pin.

3. A puffer type gas circuit breaker of the type comprising:

a. an interrupter unit comprising a main fixed contact, a main movable contact movably disposed in opposed relation with said main fixed contact between a position where it is in contact with and a position where it is separated from said main fixed contact, and a puffer device for compressing and blowing arc-affecting gases across the arc established between said main fixed and movable contacts when the same are separated from each other, b. a preinsertion resistor contact unit electrically connected in parallel with the main fixed and movable contacts of the interrupter unit and comprising a fixed resistor contact, a preinsertion resistor assembly electrically connected in series with said fixed resistor contact, and a movable rod-shaped resistor contact having a contact end and being movably disposed in opposed relation with said fixed resistor contact between a closed position where it is in contact with and an open position where it is separated from said fixed resistor contact, and having means for biasing said movable resistor contact into a normally open position, c. a first operating means for actuating said main movable contact and said puffer device, and d. a second operating means comprising a driving member adapted to be pressed at one end thereof against the end of the movable rod-shaped resistor contact opposite to the contact end thereof, linkage means connected at one end thereof to said first operating means, a pushing member having one end thereof disposed in opposed relation with the other end of said driving member to be pressed thereagainst, first lever means having one end thereof pivotally supported, having its other end connected to said pushing member and being biased to return to its normal position, second lever means having a first point connected to the other end of said linkage means, a second point connected to said first lever means, and a third point for biasing said first lever means to cause a pivotal movement thereof to move said pushing member, said driving member and said movable resistor contact from an original position where said movable and fixed resistor contacts are separated to a position where said movable and fixed resistor contacts are engaged in response to operation of said linkage means, and release means for releasing said pushing member from said driving member and for returning only the movable rod-shaped resistor contact and the driving member to their original positions immediately after said movable rod-shaped resistor contact engages with said fixed resistor contact and both the contacts of the interrupter unit are closed.

4. A puffer type gas circuit breaker as set forth in claim 3, wherein said release means comprises a cam member.

5. A puffer type gas circuit breaker as set forth in claim 1 wherein said rod-shaped movable resistor contact is provided physically independently of said operating linkage means, but is operatively coupled in such a way that they may be pressed against each other.

6. A puffer type gas circuit breaker as set forth in claim 1, wherein said linkage means comprises a first operating linkage interconnecting said operating means and said main movable contact of said interrupter unit; and a second operating linkage operatively interconnecting said first operating linkage and said movable resistor contact of said preinsertion resistor contact unit, said second operating linkage including engaging and releasing means which causes said second operating linkage to engage with said movable resistor contact when said second operating linkage is actuated in the direction in which said movable resistor contact is forced into contact with said fixed resistor contact, and which means causes said second operating linkage to be released from said movable resistor contact when said second operating linkage is actuated further in said direction after said movable resistor contact has been brought into contact with said fixed resistor contact, thereby separating said movable contact from said fixed resistor contact.

* * * * *